United States Patent [19]

Goodridge et al.

[11] 4,270,995

[45] Jun. 2, 1981

[54] ELECTROCHEMICAL CELL AND PROCESS

[75] Inventors: Francis Goodridge; Raymond E. Plimley, both of Newcastle-upon-Tyne, England

[73] Assignee: Diamond Shamrock Corporation, Dallas, Tex.

[21] Appl. No.: 57,489

[22] Filed: Jul. 13, 1979

[51] Int. Cl.[3] ..... C25B 3/02; C25B 3/06; C25B 9/00; C25B 15/08

[52] U.S. Cl. ..... 204/79; 204/81; 204/268; 204/270; 204/276; 204/277

[58] Field of Search ..... 204/79, 81, 267–270, 204/275–278, 237

[56] References Cited

U.S. PATENT DOCUMENTS

| | | | |
|---|---|---|---|
| 3,632,497 | 1/1972 | Leduc | 204/263 |
| 3,835,020 | 9/1974 | Galneder | 204/270 X |
| 4,014,776 | 3/1977 | Giacopelli | 204/267 X |
| 4,048,047 | 9/1977 | Beck et al. | 204/269 X |
| 4,141,804 | 2/1979 | Avedesian et al. | 204/277 X |

*Primary Examiner*—Delbert E. Gantz
*Assistant Examiner*—D. R. Valentine
*Attorney, Agent, or Firm*—Joseph Patrick Burke; John P. Hazzard

[57] ABSTRACT

An electrochemical cell comprises a housing (1,2) divided by a perforated generally horizontal plate (3) into an upper chamber (4) and a lower chamber (5). Bipolar electrodes (19, 21) are disposed in the upper chamber (4) above perforations (23) in the plate (3), between electrolyte inlet and outlet weirs (11, 13) for flowing electrolyte over the plate (3). The lower chamber (5) is a gas-supply chamber for passing a gas, e.g. propylene, up through the perforations (23), so as to bubble the gas through electrolyte (e.g. NaBr solution) on the plate (3) and into the upper gas-collection chamber (4). A reactor may be formed by stacking several cells with their electrolyte flows in cascade. The cell is particularly suitable for electro-organic syntheses involving a gaseous reactant.

26 Claims, 4 Drawing Figures

ELECTROCHEMICAL CELL AND PROCESS

TECHNICAL FIELD

The invention relates to electrochemical cells, particularly for carrying out electrochemical reactions involving a gaseous reactant or in which gas is supplied for another purpose such as purging or sweeping away a product of reaction, or as a buffering agent or to inhibit unwanted reactions.

The invention is more specifically, but not exclusively, concerned with an electrochemical cell for electro-organic synthesis, for example the electrochemical oxidation of unsaturated and poly-unsaturated hydrocarbons. The electrochemical production of propylene oxide is particularly interesting, and will be discussed in greater detail by way of example.

BACKGROUND ART

In the electrochemical production of propylene oxide, propylene is converted to propylene halohydrin by reaction with halogen generated in situ by the anodic oxidation of the halide salt of an alkali metal in aqueous solution. The propylene halohydrin is converted to propylene oxide by reaction with the hydroxyl group at the cathode from which hydrogen is liberated. The general scheme of reaction when sodium bromide is used as the electrolyte is:

Anode
$$2\,Br^- \longrightarrow Br_2 + 2\,e$$
$$C_3H_6 + Br_2 + H_2O \longrightarrow C_3H_6BrOH + HBr$$

Cathode
$$2\,H_2O \longrightarrow H_2 + 2\,OH^- - 2e$$
$$C_3H_6BrOH + OH \longrightarrow C_3H_6O + H_2O + Br$$

Overall
$$C_3H_6 + H_2O \longrightarrow C_3H_6O + H_2$$

In principle, only water, propylene and electrical energy are consumed in the formation of propylene oxide and hydrogen. The halide electrolyte, sodium bromide, is continuously oxidized and regenerated within the cell for further use, although losses of bromine may be caused by the formation of hypobromite and bromine gas.

The advantages of this electrochemical route, which obviates the production of waste calcium chloride encountered in the conventional chemical process, have long been recognized but attempts to implement it have not proved to be very effective.

French Patent Specification No. 1,375,973 and W. German Auslegeschrift No. 1,258,856 proposed the use of diaphragm cells in which propylene halohydrin is generated at a porous anode and passes through the diaphragm into an alkaline catholyte in a porous cathode where it is saponified to propylene oxide. However, these cells are complex and the efficiency low.

U.S. Pat. No. 3,394,059 proposed carrying out the halohydrin process in a non-divided cell, preferably a flowing mercury cathode cell, in which propylene was simply bubbled into the electrolyte. Again, the performance was poor and F. Beck (IUPAC XXIVth International Congress, Hamburg, 1973, Vol. 5, "Applied Electrochemistry", pages 111–136) has claimed an improved performance using a capillary gap cell. In this, propylene dispersed in a dilute NaBr electrolyte is supplied through a central hole in a pile of electrode discs and flows radially outwards between the discs. Th gap between the electrode discs was made small (0.2 to 0.5 mm) to enable low bromide concentrations to be handled with low ohmic losses. A current efficiency of 70% or just above and an energy consumption of 0.23–0.30 kwh/gmol propylene oxide are reported for a small capillary gap cell, but scaling up this cell for industrial production would involve difficulties.

Fleischmann et al. (Symposium on Electrochemical Engineering I, Newcastle 1971, Editor J. D. Thornton) have studied the synthesis of propylene oxide using a bipolar packed bed cell. The cell consisted of a packed bed made up of a mixture of conducting and non-conducting particles. The conducting particles become biplar by using dilute electrolyte in the cell and applying sufficient voltage gradient between the contact electrodes so as to overcome the resistance drop in the electrolyte. Using glass coated with graphite as the conducting particles and glass beads as the non-conducting particles, all particles having a diameter of about 0.05 cm, the energy consumption of such a cell was found to be high, in the range of 2.5–3 kwh/gmol propylene oxide.

A bipolar rod flow cell was used by King et al. (Trans. Inst. Chem. Eng., 53, 1975) for the production of propylene oxide. The cell consisted of vertical rows of electrically-conductive rods, separated from one another by a small gap. The electrolyte was fed to the top rods, flowed downwards over the vertical rows and was collected from the bottom rods for recirculation. The gaseous reactant, propylene, was passed up the space between the vertical rows, in continuous contact with the electrolyte film. The current efficiency of this cell was of the order of 70% and the energy consumption is estimated in the range 0.35–0.4 kwh/gmol propylene oxide.

R. E. W. Jansson et al. have developed a bipolar electrochemical pump cell for which an energy yield below 0.2 kwh/gmol of propylene oxide is claimed (Journal of App. Electrochemistry, 7, (1977), 437–443) for trial experiments on a laboratory scale using a cathode rotating at 3000 rpm with an electrode gap of 0.25 mm. However, the structure is not easily scaled-up for industrial production.

Various other cell structures designed to provide a gas supply to the electrolyte are also known. For example, in the electrowinning of metals such as copper, it is well known to supply a gas through bubble tubes situated below the electrodes in order to agitate the electrolyte (e.g. see U.S. Pat. No. 3,875,041 and the earlier patents referred to therein). Another suggestion made in U.S. Pat. No. 3,259,049 was to provide electrolyte agitation in an electroplating tank using a hollow, flat manifold which is placed in the electrolyte, under the electrodes, and has a perforated upper surface for bubbling gas up into the electrolyte, the gas being supplied to the manifold via a gas flow tube. In contrast to the fixed bubbletube arrangements, the entire manifold structure was made removable to facilitate periodic cleaning to remove fragments which may block the perforations in the manifold.

DISCLOSURE OF INVENTION

An object of the invention is to provide an electrochemical cell specifically (but not exclusively) for the production of propylene oxide and which can be designed to meet up to the following requirements better than the previously proposed cells:

(1) Simplicity of the mechanical construction;

(2) Good heat and mass transfer characteristics;
(3) Simplicity of operation and continuous operation;
(4) Good gas-liquid contact; and
(5) Good mixing of anolyte and catholyte products.

According to the invention, in its simplest form, an electrochemical cell comprises electrodes disposed over a perforated generally horizontal plate, an electrolyte inlet and an electrolyte outlet spaced apart on opposite sides of the electrodes across the perforated plate, and a cell housing which is divided by the perforated plate into an upper chamber and a lower chamber. The lower chamber is a gas supply chamber from which, in use, gas passes up through perforations in the plate and bubbles through electrolyte on the plate to collect in the upper chamber.

The electrolyte inlet and electrolyte outlet of the cell are each advantageously formed by a weir. The top of the inlet weir is higher than the top of the outlet weir which in turn is higher than the top of the electrodes. Hence, by controlling the supply of fresh electrolyte to the inlet weir, the electrolyte is made to flow over the inlet weir and between the electrodes as it passes across the perforated plate, while spent or reacted electrolyte flows out over the outlet weir at a chosen rate. These weirs may be formed by upstanding plates integral with or fixed on the perforated plate.

The electrodes, advantageously a bipolar array of vertical plate-like electrodes disposed in spaced parallel relationship to provide channels between the electrolyte inlet and outlet, may rest on the perforated plate which, in this instance, will be made of electrically insulating material. The perforations in the plate can be arranged in rows each spaced about mid-way between adjacent electrodes. Perforations in the form of generally circular bores having a diameter of about 1 mm have been found satisfactory, but perforations of other form and size can be used.

The bottom of the lower chamber of the cell housing can serve as a receptacle for a pool of spent or reacted electrolyte which flows via a downcomer tube leading from the aforementioned outlet weir into the pool from which electrolyte is removed via an outlet and may be recycled. Fresh electrolyte can be supplied to the aforementioned inlet weir via an incomer tube which extends down through the upper chamber of the cell housing into the electrolyte retained by the inlet weir.

The upper and lower chambers may be formed by upper and lower sections of a box-like cell housing, these sections being separated by the aforesaid plate which is perforated only in the region under the electrodes. A rectangular enclosure for the electrodes may thus be formed by the side walls of the upper housing section fitting against upstanding plates forming the inlet and outlet weirs. These side walls can carry inset terminal electrodes of the electrode array.

The invention also concerns an electrochemical reactor formed by stacking several cells according to the invention in a column whereby the gas-collection chamber of each cell (except the top one) forms the gas-supply chamber for the cell above. In other words, the perforated plate of each cell (except the lowest one) forms the top of the gas-collection chamber of the cell below. With this arrangement, in operation, gas passes up through the cells from the bottom of the column to the top, bubbling through the electrolyte in each cell. Preferably, the electrolyte outlets and inlets of the successive cells are connected in cascade so that the electrolyte flows down the column from one cell to the next, the electrolyte flowing across the perforated plate of each cell from the inlet to the outlet and then down to the inlet of the cell below. Each cell of such a reactor can have the aforementioned preferred features of a single cell unit, such as the electrolyte inlets and outlets being formed by weirs.

Another aspect of the invention is a method of carrying out an electrochemical process or reaction using a cell according to the invention, this method comprising passing gas up through the perforations in the plate so that it bubbles into the electrolyte on the plate. Depending on the reaction, the method may be operated continuously, i.e. continuously supplying gas, electrolyte and electric current, or discontinuously, i.e. with an intermittent supply of gas, electrolyte and/or current.

Yet another aspect of the invention is a method of carrying out an electrochemical process or reaction using a reactor formed by a column of cells according to the invention, this method comprising flowing electrolyte down the column from one cell to the next and across the perforated plate of each cell, and passing gas up through the perforations in the successive plates so that the gas bubbles through the electrolyte on each plate. This method may also be operated continuously or discontinuously.

The gas may be a reactant or a mixture of reactants, or may serve another purpose, for instance an inert purge gas such as nitrogen may be used to sweep away a product of reaction, or a buffering agent such as $CO_2$ or $NH_3$ may be used to control the pH of the electrolyte, for example to inhibit unwanted reactions.

In addition to the preparation of propylene oxide, the cell according to the invention could be used in the electro-synthesis of other products such as the formation of butylene oxide from butene.

Another important application is the electrochemical treatment of some effluent gases. Generally speaking, many applications concern the situation where one or more of the reactants is a gas and where mixing of anolyte and catholyte is advantageous or inconsequential.

BRIEF DESCRIPTION OF DRAWINGS

Embodiments of the invention are shown, by way of example, in the accompanying drawings, in which.

BEST MODES FOR CARRYING OUT THE INVENTION

Figure 1:
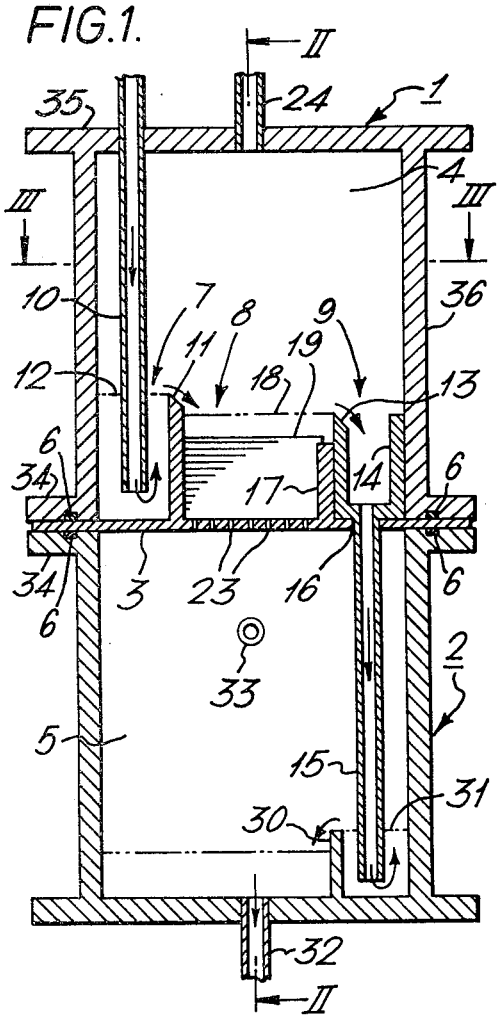
FIG. 1 is a cross-section of a cell along the line I—I of FIG. 2.
Figure 2:
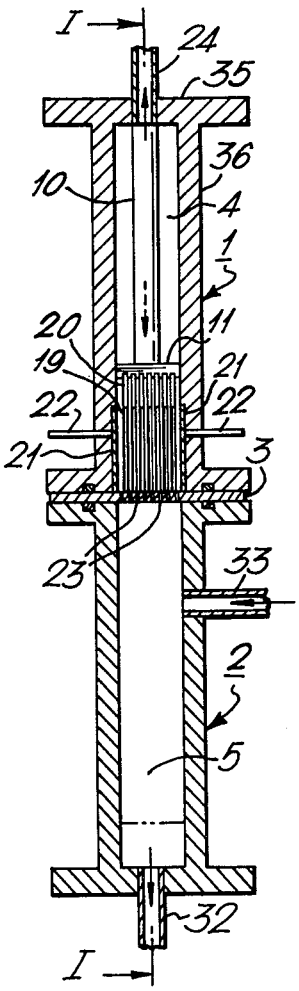
FIG. 2 is a cross-section along the line II—II of FIG. 1.
Figure 3:
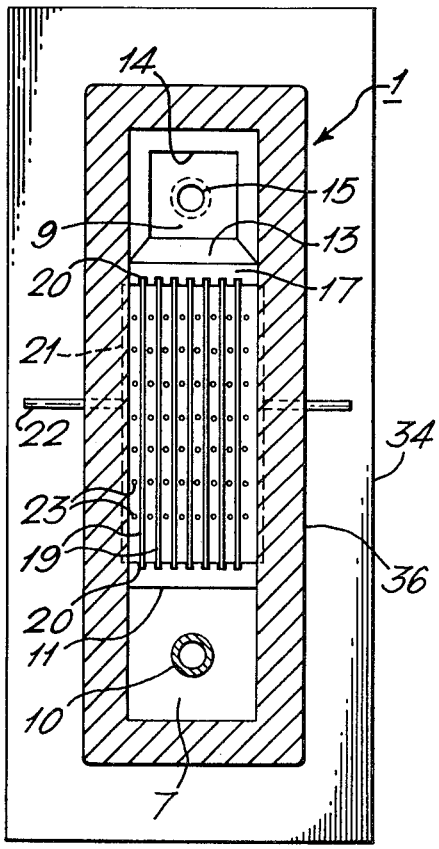
FIG. 3 is a sectional view of the cell of FIGS. 1 and 2 along the line III—III of FIG. 1.

The cell of FIGS. 1 to 3 comprises a generally rectangular box-like housing composed of an upper section 1 and a lower section 2. A plate 3, fixed between flanges 34 of the upper and lower sections 1,2 divides the housing into an upper chamber 4 and a lower chamber 5. The joints between the flanges 34 and the plate 3 are sealed by gaskets 6.

The upper chamber 4 has an electrolyte inlet section 7, an electrode section 8 and an electrolyte outlet section 9. The inlet section 7 comprises an incomer tube 10 which passes through the top 35 of the upper section 1 and extends down to near the plate 3, between an upstanding plate 11 and three side walls 36 of the section 1. The plate 11, which is integral with the plate 3, extends across the width of the chamber 4 and forms an inlet weir which, in use, holds a pool of electrolyte at a level 12, this electrolyte being delivered via the incomer tube 10.

The electrolyte outlet section 9 comprises an outlet weir plate 13 which also extends across the width of the chamber 4, but is formed by one wall of an enlarged square end 14 of a downcomer tube 15 which passes through a hole 16 in the plate 3. The square end 14 is fitted in a corresponding square recess defined by the side walls 36 of the upper section 1 and an upstanding plate 17 integral with the plate 3. The top of the outlet weir plate 13, is lower than the top of the inlet weir plate 11 and, in use, it maintains electrolyte in the electrode section 8 at a level 18.

In the electrode section 8 are disposed seven electrodes 19 in the form of plates held in spaced parallel relationship in vertical grooves 20 in the plates 11 and 17. The electrodes 19 are disposed between two terminal electrodes 21 which are inset in the side walls 36 through which pass current leads 22. The plate 11 at one end of the spaced electrodes, and the plates 17 and 13 at the other end define, with the side walls 36 of the section 1, an electrolyte receptacle whose bottom is formed by a perforated central part of the plate 3. The perforations in the plate 3, indicated at 23, are in the form of circular holes or bores having a diameter of about 1 mm, arranged in eight rows each of seven equally-spaced holes disposed mid-way between the adjacent electrodes 19 or 19 and 21.

The upper housing section 1 also comprises, in its top 35, a gas outlet pipe 24 for the removal of gas from the upper chamber 4.

In the lower chamber 5, the downcomer tube 15 extends near to the bottom, below the level of an upstanding wall 30 which forms a trap or weir holding a pool of outgoing electrolyte at a level 31. In the bottom of the lower section 2 is an outlet pipe 32 for removing the electrolyte which has flowed over the weir wall 30. The lower housing section 2 also has a gas inlet pipe 33 for delivering gas into the lower chamber 5. Electrolyte in the bottom of the chamber 5 prevents this gas from escaping via the outlet pipe 32 or the down-comer tube 15, so that the gas passes up through the perforations 23 in the plate 3 and bubbles into the electrolyte between the electrodes 19, and 19 and 21 in the electrode section 8.

To operate the cell, the electrolyte outlet pipe 32 is connected to the incomer tube 10 by an electrolyte circulating system, and the gas outlet pipe 24 is connected to the inlet pipe 33 by a gas circulating system. The electrolyte is circulated at a chosen rate so that fresh electrolyte from the incomer tube 10 flows over the inlet weir, namely the plate 11, across the electrodes section 8, i.e. through the parallel channels defined between the electrodes 19, and 19 and 21, and out over the outlet weir plate 13. The gas is also circulated at a chosen rate, which can be adjusted independently of the electrolyte flow rate. It passes from the lower chamber 5 up through the perforations 23 and bubbles through the electrolyte between the electrodes 19, and 19 and 21 into the upper or gas-collection chamber 4. When all of the flows have been set up, current is supplied to the electrodes 19 and 21. In some instances, i.e. when the gas is a reactant, current is supplied to the electrodes as the gas is supplied, and the operation is advantageously continuous, i.e. with constant electrolyte and gas flowrates. In other instances, however, it may be advantageous to operate discontinuously, i.e. with an intermittent flow of electrolyte or gas or both, with current supply during the appropriate phase. The product of the electrochemical reaction may be taken off as a gas and removed from the gas stream before recirculating, or may be taken off dissolved in the electrolyte, in which case it is removed from the electrolyte before recycling. For the production of propylene oxide, the product will partition itself between the electrolyte and the gas phase and may therefore advantageously be removed through the gas outlet pipe 24 and separated by condensation.

INDUSTRIAL APPLICABILITY

A cell as shown in FIGS. 1 to 3 was used for the production of propylene oxide. The electrodes were plates of graphite each 6.3 cm high, 8.3 cm long and 0.3 cm thick and spaced apart by a distance of about 4 mm. The electrolyte, 5 liters of 0.1 M or 0.2 M NaBr solution, was flowed at a constant rate, in the range from about 20 to 45 $cm^3$/sec. Propylene gas was also circulated, using a supply of fresh propylene at a constant rate in the range from about 5 to 40 $cm^3$/sec. Before supplying a constant current (at from 1 to 2 A and a constant voltage from 25 to 40 V), the propylene was circulated for several minutes to remove air from the cell housing and to saturate the electrolyte solution. Operation was carried out at ambient temperature and atmospheric pressure and the pH of the electrolyte was maintained between about 11 and 12 by adding HBr solution. Gas and liquid samples were checked at ½ hourly intervals. In some instances, a foaming agent ("Decon", Trademark) was added with a view to promoting rapid mass transport of the reactants to the electrodes, and to increase the solubility of propylene. The results showed a high current efficiency, about 80%, and a low energy consumption, 0.2 to 0.3 kwh/gmol of propylene oxide when operating at low temperature, low current and low gas flowrate using dilute NaBr. For the epoxidation of 1-butene using the same cell, an energy consumption of 0.26 kwh/gmol of butylene oxide was achieved at a current efficiency approaching that obtained with propylene oxide. These performances may be improved by optimizing the cell dimensions and process conditions and, possibly, by operating at elevated pressures.

Figure 4:
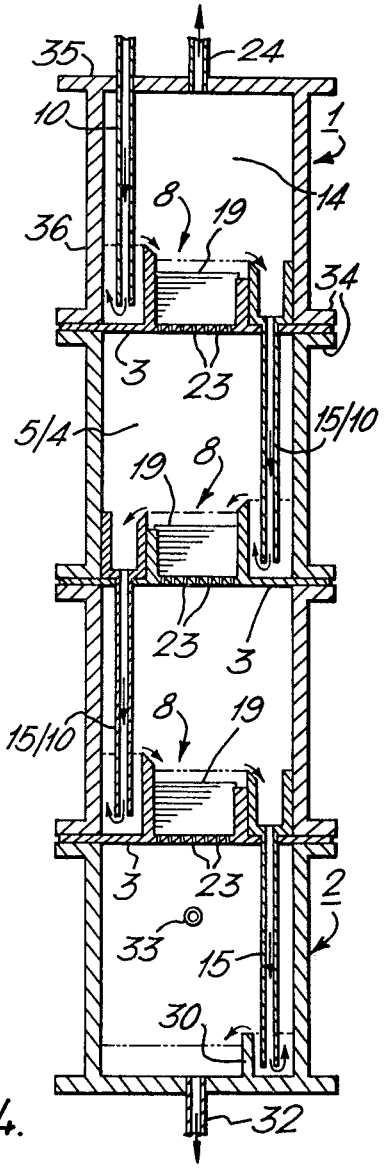
FIG. 4 is a cut-away view similar to FIG. 1, of part of a column formed of several cells connected in cascade.

As shown in FIG. 4, several cells similar to that of FIGS. 1 to 3 can be stacked in a column with the electrolyte flow system connected in cascade. In FIG. 4, the same parts are designated by the same references as before, some parts of the intermediate cells being designated by double references. The upper section 1 of the housing of the top cell and the lower section 2 of the housing of the bottom cell are exactly the same as the upper and lower sections 1 and 2 of FIGS. 1 and 2. However, in the reactor column, the perforated plate 3 forming the bottom of one cell also forms the top of the gas collection chamber 4 of the cell below and its perforations 23 act as the gas outlet for that chamber; the downcomer tube 15 for the discharge of electrolyte from one cell forms the incomer tube 10 of the cell below; the gas collection chamber 4 of each cell (except the top one) forms the gas supply chamber 5 for the cell above; and so forth.

In operation of this reactor column, gas is supplied at the bottom of the column, via the inlet pipe 33, passes up through the successive cells, bubbling up through the electrolyte in each electrode section 8, and is removed from the top of the column via the outlet pipe 24. Electrolyte is supplied at the top 35 of the column via the top incomer tube 10 and, as indicated by the arrow, cascades down from one cell to the next, flowing across the electrode section 8 of each cell, and is removed from the bottom of the column via the outlet pipe 32. As before, current is supplied to the electrodes of each cell and the operation may be continuous or discontinuous.

Many variations may be made to the described embodiments. Various electrode materials can be used, depending on the reaction: in particular, dimensionally-stable metal electrodes will be preferred for some reactions. Also, the electrodes need not be bipolar. In some instances, spaced parallel electrodes can be disposed transverse to the general direction of flow of electrolyte across the perforated plate. Various shapes and sizes of perforations can be provided in this plate and, instead of being disposed between the adjacent electrodes, for certain reactions these perforations could lead into porous or foraminous electrodes disposed on the perforated plate. Instead of the preferred electrolyte inlet and outlet weirs, other means could be provided to enable a flow of the electrolyte generally across the perforated plate, while maintaining a given electrolyte level.

We claim:

1. An electrochemical cell, comprising electrodes disposed over a perforated generally horizontal plate, an electrolyte inlet disposed above the perforated plate on one side of the electrodes and an electrolyte outlet spaced apart from said inlet on an opposite side of the electrodes, and a cell housing which is divided by the perforated plate into an upper chamber and a lower chamber, wherein a top part of the lower chamber is a gas supply chamber for passing gas via the perforations in the perforated plate through an electrolyte when located above the plate in the upper chamber, and a bottom part of the lower chamber constitutes a receptacle for a pool of reacted electrolyte from said outlet.

2. The electrochemical cell of claim 1, comprising a bipolar array of vertical plate-like electrodes disposed in spaced parallel relationship to define channels between the electrolyte inlet and the electrolyte outlet.

3. The electrochemical cell of claim 1, wherein the upper and lower chambers are formed by respective separate upper and lower sections of a box-like cell housing, the housing sections are separated by and secured to the periphery of the plate and the perforations are disposed in the plate only in the region under the electrodes.

4. An electrochemical cell, comprising:

a cell housing;

a perforated generally horizontal plate dividing the cell housing into an upper chamber and a lower chamber;

electrodes disposed in the upper chamber over perforations in the perforated plate;

and means defining an electrolyte inlet disposed above the perforated plate on one side of the electrodes and an electrolyte outlet spaced apart from said inlet on an opposite side of the electrodes to maintain electrolyte on the perforated plate at an intermediate level of the upper chamber so as at least partially to immerse the electrodes and define a gas-collection space in the upper chamber above the electrolyte;

a top part of the lower housing chamber constituting a gas supply chamber for passing gas up through perforations in the plate so as to bubble the gas through the electrolyte on the plate and into the gas-collection space and a bottom part of the lower chamber constituting a receptacle for a pool of reacted electrolyte from said outlet.

5. An electrochemical reactor comprising:

a reactor housing;

a plurality of mutually-spaced perforated generally horizontal plates disposed in superimposed relationship to divide the reactor housing into superimposed chambers;

electrodes disposed in each chamber (except the lowest one) over perforations in the respective plate;

means defining an electrolyte inlet and an electrolyte outlet spaced apart on opposite sides of the electrodes across each perforated plate to maintain electrolyte on the perforated plate at an intermediate level of the respective chamber so as at least partially to immerse the respective electrodes and define a gas-collection space in the chamber above the electrolyte;

each chamber (except the top one) constituting a gas-supply chamber for passing gas up through perforations in perforated plate at the top of the chamber to bubble the gas through the electrolyte on the plate and into the gas-collection space in the chamber thereabove and which (except for that of the top cell) from the gas-supply chamber for the cell above;

and means connecting the electrolyte outlets and inlets of successive cells in cascade to flow electrolyte down the reactor from the electrolyte outlet of one cell to the electrolyte inlet of the cell below.

6. A method of carrying out an electrochemical process or reaction in an electrochemical cell comprising electrodes disposed over a perforated generally horizontal plate, an electrolyte inlet disposed above the perforated plate on one side of the electrodes and an electrolyte outlet spaced apart from said inlet on an opposite side of the electrodes and a cell housing which is divided by the perforated plate into an upper chamber and a lower chamber, said lower chamber having a top part constituting a gas-supply chamber and a bottom part constituting a receptacle for a pool of reacted electrolyte from said outlet, the method comprising passing gas from the gas-supply chamber up through perforations in the plate to bubble through electrolyte on the plate and collect in the upper chamber and flowing electrolyte across the perforated plate from said inlet to said outlet and down from said outlet to said bottom part of the lower chamber.

7. A method of carrying out an electrochemical process or reaction in an electrochemical reactor comprising (I) a plurality of cells, each cell comprising (i) electrodes disposed over a perforated generally horizontal plate and (ii) an electrolyte inlet and (iii) an electrolyte outlet spaced apart on opposite sides of the electrodes across the perforated plate, and (II) a reactor housing in which the cells are stacked in a columnar arrangement, the perforated plates dividing the reactor housing into superimposed chambers, each perforated plate being disposed over a gas-supply chamber for passing gas up through perforations in the plate to bubble through electrolyte on the plate and collect in the chamber thereabove and which (except for that of the top cell) forms the gas-supply chamber for the cell above, the method comprising flowing electrolyte down the columnar reactor from one cell to the next and across the perforated plate of each cell, and passing gas up through the perforations in the successive plates so that the gas bubbles through the electrolyte on each plate.

8. The method of claim 6 or 7, wherein the gas is a reactant in the electrochemical reaction.

9. The method of claim 6 or 7, wherein the gas is propylene and the electrolyte is a halide salt of an alkali metal in aqueous solution.

10. An electrochemical cell, comprising electrodes disposed over a perforated generally horizontal plate, an electrolyte inlet weir and an electrolyte outlet weir spaced apart on opposite sides of the electrodes across the perforated plate, and a cell housing which is divided by the perforated plate into an upper chamber and a lower chamber, wherein the lower chamber is a gas supply chamber for passing gas via the perforations in the perforated plate through the electrolyte located above the plate in the upper chamber.

11. The electrochemical cell of claim 10, wherein the top of the electrolyte inlet weir is higher than the top of the electrolyte outlet weir which is higher than the top of the electrodes.

12. The electrochemical cell of claim 10 or 11, wherein the weirs are formed by plates upstanding from the perforated plate.

13. An electrochemical cell, comprising an array of vertical plate-like bipolar electrodes disposed in spaced parallel relationship and resting on a perforated generally horizontal plate made of electrically-insulating material having perforations arranged in rows spaced about midway between adjacent electrodes, an electrolyte inlet and an electrolyte outlet spaced apart on opposite sides of said electrodes with said bipolar electrodes defining channels between said inlet and said outlet, and a cell housing divided by said perforated plate into an upper chamber and a lower chamber, wherein the lower chamber is a gas supply chamber for passing gas via the perforations in the perforated plate through the electrolyte located above the plate in the upper chamber.

14. The electrochemical cell of claim 10, wherein a bottom part of the lower chamber forms a receptacle for a pool of reacted electrolyte, and a downcomer tube leads from the electrolyte weir to the bottom part of the lower chamber, for the delivery of reacted electrolyte to the pool.

15. The electrochemical cell of claim 14, comprising an incomer tube extending down through the upper chamber, for the delivery of fresh electrolyte to the electrolyte inlet weir.

16. An electrochemical cell comprising electrodes disposed over a perforated generally horizontal plate having perforations only in the region under said electrodes, an electrolyte inlet and an electrolyte outlet spaced apart on opposite sides of the electrodes across said perforated plate and box-like cell housing divided by said plate into separate respective upper and lower housing chambers within said housing chambers are separated by and secured to the periphery of said plate and wherein the lower chamber is a gas supply chamber for passing gas via said perforations through said electrolyte located above said plate in said upper chamber and wherein said upper housing chamber has facing side walls which fit against upstanding plate forming electrolyte inlet and outlet weirs to define a rectangular enclosure for said electrodes.

17. The electrochemical cell of claim 16, comprising a bipolar array of vertical plate-like electrodes disposed in spaced parallel relationship to define channels between the electrolyte inlet and electrolyte outlet weirs, said electrode array including terminal electrodes inset in said facing side walls of the upper housing section.

18. An electrochemical reactor comprising (I) a plurality of cells, each cell comprising (i) electrodes disposed over a perforated generally horizontal plate and (ii) an electrolyte inlet weir and (iii) an electrolyte outlet weir spaced apart on opposite sides of the electrodes across the perforated plate, and (II) a reactor housing in which the cells are stacked in a columnar arrangement, the perforated plates of the cells dividing the reactor housing into superimposed chambers, each perforated plate being disposed over a gas-supply chamber for passing gas up through perforations in the plate to bubble through electrolyte on the plate and collect in the chamber thereabove and which (except for that of the top cell) forms the gas-supply chamber for the cell above.

19. The electrochemical reactor of claim 18, wherein the top of the electrolyte inlet weir of each cell is higher than the top of the electrolyte outlet weir which is higher than the top of the electrodes.

20. The electrochemical reactor of claim 18 or 19, wherein the weirs are formed by plates upstanding from the perforated plates.

21. An electrochemical reactor comprising (I) a plurality of cells, each cell comprising (i) a bipolar array of vertical plate-like electrodes disposed in spaced parallel relationship to define channels resting on and over a perforated generally horizontal plate of electrically-insulating material and between (ii) an electrolyte inlet and (iii) an electrolyte outlet, said perforations being arranged in rows spaced about midway between the respective adjacent electrodes, and (II) a reactor housing in which the cells are stacked in a columnar arrangement, said perforated plates of said cells dividing said reactor housing into superimposed chambers, each said perforated plate being disposed over a gas-supply chamber for passing gas up through perforations in the plate to bubble through electrolyte on the plate and collect in the chamber thereabove and which (except for that of the top cell) forms the gas supply chamber for the cell above.

22. The electrochemical reactor of claim 18, comprising downcomer tubes for delivering electrolyte from the electrolyte outlet weir of each cell (except the lowest one) to the electrolyte inlet weir of the cell below.

23. The electrochemical reactor of claim 21, wherein a bottom part of the lowest chamber forms a receptacle for a pool of reacted electrolyte and a further downcomer tube leads from the electrolyte outlet of the lowest cell to the bottom part of the lowest chamber, for the delivery of reacted electrolyte to the pool.

24. The electrochemical reactor of claim 22, comprising an incomer tube extending down through the top chamber, for the delivery of fresh electrolyte to the electrolyte inlet weir of the top cell.

25. An electrochemical reactor comprising (I) a plurality of cells, each cell comprising
  (i) electrodes disposed over a perforated generally horizontal plate wherein said perforations are located only in the regions under said electrodes, and
  (ii) an electrolyte inlet and
  (iii) an electrolyte outlet spaced apart on opposite sides of the electrodes across the perforated plate, and (II) a reactor housing the respective sections of which are separated by and secured to the periphery of the respective horizontal plates and in which the cells are stacked in a columnar arrangement, the perforated plates of the cells dividing the reactor housing into superimposed chambers, each perforated plate being disposed over a gas-supply chamber for passing gas up through perforations in the plate to bubble through electrolyte on the plate and collect in the chamber thereabove and which (except for the top cell) forms the gas-supply chamber for the cell above and wherein each housing section (except the lowest one) has facing side walls which fit against upstanding plates forming electrolyte inlet and outlet weirs to define a rectangular enclosure for the electrodes of the respective cell.

26. The electrochemical reactor of claim 25, wherein each cell comprises a bipolar array of vertical plate-like electrodes disposed in spaced parallel relationship to define channels between the electrolyte inlet and outlet weirs of the cell, each electrode array including terminal electrodes inset in the facing side walls of the respective housing section.

* * * * *

UNITED STATES PATENT AND TRADEMARK OFFICE

CERTIFICATE OF CORRECTION

PATENT NO. : 4,270,995

DATED : June 2, 1981

INVENTOR(S) : Francis Goodridge; Raymond E. Plimley

It is certified that error appears in the above-identified patent and that said Letters Patent is hereby corrected as shown below:

On the title page, please insert

" [30] Foreign Application Priority Data

November 28, 1977 [U.K.] United Kingdom 49411/77
October 13, 1978 [U.K.] PCT/GB78/00025"

Col. 8, line 28, change "from" to "forms"

Col. 10, line 58, change "21" to "22"

Col. 10, line 64, change "22" to "23"

Signed and Sealed this

Twelfth Day of October, 1993

Bruce Lehman

*Attest:*

BRUCE LEHMAN

*Attesting Officer*

*Commissioner of Patents and Trademarks*